US009986810B2

(12) United States Patent
Bobillier et al.

(10) Patent No.: US 9,986,810 B2
(45) Date of Patent: Jun. 5, 2018

(54) HAND HELD APPLIANCE

(71) Applicant: Dyson Technology Limited, Wiltshire (GB)

(72) Inventors: Ben Colin Bobillier, Bath (GB); William Keith Hassett, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days. days.

(21) Appl. No.: 15/297,847

(22) Filed: Oct. 19, 2016

(65) Prior Publication Data

US 2017/0112256 A1 Apr. 27, 2017

(30) Foreign Application Priority Data

Oct. 21, 2015 (GB) ..... 1518644.8

(51) Int. Cl.
*A45D 20/12* (2006.01)

(52) U.S. Cl.
CPC ..... *A45D 20/12* (2013.01)

(58) Field of Classification Search
CPC ..... A45D 20/10; A45D 20/12; G05D 23/306; H05K 5/003; H05K 7/1401
USPC ..... 34/96–100; 392/384, 385
See application file for complete search history.

(56) References Cited

U.S. PATENT DOCUMENTS 2,514,528 A 7/1950 Wahl
3,261,107 A 7/1966 Ponczek et al.
3,439,204 A 4/1969 Ponczek et al.
3,610,881 A 10/1971 Stewart
4,085,309 A 4/1978 Godel et al.
4,260,875 A 4/1981 Walter et al.
4,327,278 A * 4/1982 Tomaro ..... A45D 20/10 219/486
4,395,619 A * 7/1983 Harigai ..... A45D 20/12 219/536

(Continued)

FOREIGN PATENT DOCUMENTS

CN 2819903 9/2006
CN 201011916 1/2008

(Continued)

OTHER PUBLICATIONS

Search Report dated Apr. 7, 2016, directed to GB Application No. 1518644.8; 2 pages.

(Continued)

*Primary Examiner* — Stephen M Gravini
(74) *Attorney, Agent, or Firm* — Morrison & Foerster LLP

(57) ABSTRACT

A hairdryer including a heater, a fluid flow path and a thermal fuse wherein the fluid flow path extends from a fluid inlet to a fluid outlet, the heater extends within the fluid flow path from an upstream end of the heater to a downstream end of the heater and the thermal fuse extends across the downstream end of the heater. The heater may be generally cylindrical in shape and the thermal fuse may extend at least partially radially across the downstream end of the heater. The heater may be annular in cross-section and the thermal fuse may extend at least partially radially across the annular downstream end of the heater. The heater may comprise an element, a scaffold around which the element is wound and an outer wall wherein the outer wall extends about the element and the scaffold.

10 Claims, 4 Drawing Sheets

(56) References Cited

U.S. PATENT DOCUMENTS

| | | | | | |
|---|---|---|---|---|---|
| 4,550,358 | A * | 10/1985 | Crowley | H02H 5/083 | 307/118 |
| 4,701,595 | A | 10/1987 | Okutsu et al. | | |
| 4,706,153 | A * | 11/1987 | Sainomoto | H02H 5/083 | 307/118 |
| 4,711,988 | A | 12/1987 | Thaler et al. | | |
| 4,720,759 | A * | 1/1988 | Tabei | H01H 37/002 | 200/83 P |
| 4,721,121 | A | 1/1988 | Adams | | |
| 4,767,914 | A | 8/1988 | Glucksman | | |
| 5,434,946 | A * | 7/1995 | Barzilai | A45D 20/12 | 34/96 |
| 5,448,677 | A | 9/1995 | Fell et al. | | |
| 5,612,849 | A | 3/1997 | Prehodka et al. | | |
| 5,642,570 | A | 7/1997 | Lee | | |
| 5,651,190 | A | 7/1997 | Sanders | | |
| 5,857,262 | A * | 1/1999 | Bonnema | A45D 20/06 | 126/409 |
| 6,191,930 | B1 | 2/2001 | Ramchandani | | |
| 6,285,828 | B1 * | 9/2001 | Cafaro | A45D 20/12 | 34/266 |
| 6,640,049 | B1 | 10/2003 | Lee et al. | | |
| 6,895,686 | B1 | 5/2005 | Sabbatini | | |
| 7,644,511 | B2 | 1/2010 | Ishikawa et al. | | |
| 7,748,343 | B2 | 7/2010 | Kim et al. | | |
| 8,015,724 | B2 | 9/2011 | Imahori et al. | | |
| 8,434,238 | B2 | 5/2013 | Gross et al. | | |
| 9,510,395 | B2 | 11/2016 | Coulton et al. | | |
| 9,526,310 | B2 | 12/2016 | Courtney et al. | | |
| 9,693,616 | B2 | 7/2017 | Sakuma et al. | | |
| 9,756,922 | B1 * | 9/2017 | Duthe | A45D 20/12 | |
| 2006/0098962 | A1 | 5/2006 | Ceva | | |
| 2007/0119069 | A1 | 5/2007 | Shim | | |
| 2007/0204477 | A1 * | 9/2007 | Lin | A45D 20/12 | 34/96 |
| 2008/0229606 | A1 | 9/2008 | Hirai | | |
| 2010/0162585 | A1 | 7/2010 | Liu et al. | | |
| 2010/0286754 | A1 | 11/2010 | Bly | | |
| 2012/0126041 | A1 | 5/2012 | Nunomura et al. | | |
| 2014/0255173 | A1 * | 9/2014 | Poulton | F04D 29/40 | 415/182.1 |
| 2015/0007855 | A1 | 1/2015 | Moloney et al. | | |
| 2015/0093099 | A1 | 4/2015 | Shelton et al. | | |
| 2016/0166035 | A1 | 6/2016 | Douglas et al. | | |
| 2016/0220004 | A1 | 8/2016 | Moloney et al. | | |
| 2017/0006991 | A1 | 1/2017 | Stephens et al. | | |
| 2017/0112255 | A1 * | 4/2017 | Saunders | A45D 20/10 | |
| 2017/0112256 | A1 * | 4/2017 | Bobillier | A45D 20/12 | |
| 2017/0112257 | A1 * | 4/2017 | Bobillier | A45D 20/12 | |
| 2017/0112258 | A1 | 4/2017 | Blanc et al. | | |
| 2017/0150798 | A1 * | 6/2017 | Bobillier | A45D 20/10 | |
| 2017/0164709 | A1 | 6/2017 | Laveni et al. | | |

FOREIGN PATENT DOCUMENTS

| | | | | |
|---|---|---|---|---|
| DE | 27 27 940 | | 12/1977 | |
| DE | 198 35 791 | | 2/1999 | |
| EP | 0 518 035 | | 12/1992 | |
| EP | 1 433 401 | | 6/2004 | |
| EP | 1 527 709 | | 5/2005 | |
| EP | 1 836 919 | | 9/2007 | |
| EP | 1 956 317 | | 8/2008 | |
| EP | 2 138 065 | | 12/2009 | |
| EP | 2 161 511 | | 3/2010 | |
| EP | 2 308 337 | | 4/2011 | |
| FR | 1.217.860 | | 5/1960 | |
| GB | 684341 | | 12/1952 | |
| GB | 2 023 351 | | 12/1979 | |
| GB | 2 048 627 | | 12/1980 | |
| GB | 2543537 | | 4/2017 | |
| IT | 1255589 | | 11/1995 | |
| JP | 51-153187 | | 5/1975 | |
| JP | 60-75007 | | 4/1985 | |
| JP | 61-75202 | | 5/1986 | |
| JP | 61-157402 | | 9/1986 | |
| JP | 61-157403 | | 9/1986 | |
| JP | 61-217648 | | 9/1986 | |
| JP | 1-291059 | | 11/1989 | |
| JP | 2-252405 | | 10/1990 | |
| JP | 3-111002 | | 5/1991 | |
| JP | 4-105603 | | 4/1992 | |
| JP | 4-338406 | | 11/1992 | |
| JP | 5-293010 | | 11/1993 | |
| JP | 6-54713 | | 3/1994 | |
| JP | 6-78826 | | 3/1994 | |
| JP | 7-213330 | | 8/1995 | |
| JP | 7-313239 | | 12/1995 | |
| JP | 8-47415 | | 2/1996 | |
| JP | 08299048 | A * | 11/1996 | A45D 20/12 |
| JP | 11-76390 | | 3/1999 | |
| JP | 3116053 | | 11/2005 | |
| JP | 2006-236707 | | 9/2006 | |
| JP | 3130650 | | 4/2007 | |
| JP | 2015-66446 | | 4/2015 | |
| JP | 2016-112424 | | 6/2016 | |
| JP | 2017-18593 | | 1/2017 | |
| JP | 2017-77471 | | 4/2017 | |
| JP | 2017077472 | A * | 4/2017 | |
| WO | WO-95/31915 | | 11/1995 | |
| WO | WO-2004/019726 | | 3/2004 | |
| WO | WO-2004/064565 | | 8/2004 | |
| WO | WO-2017/068321 | | 4/2017 | |

OTHER PUBLICATIONS

European Search Report dated Feb. 20, 2017, directed to EP Application No. 16 19 1219; 6 pages.
Bobillier et al., U.S. Office Action dated Sep. 19, 2017, directed to U.S. Appl. No. 15/297,932, 8 pages.
Saunders et al., U.S. Office Action dated Sep. 26, 2017, directed to U.S. Appl. No. 15/297,935; 7 pages.

* cited by examiner

HAND HELD APPLIANCE

REFERENCE TO RELATED APPLICATIONS

This application claims the priority of United Kingdom Application No. 1518644.8, filed Oct. 21, 2015, the entire contents of which are incorporated herein by reference.

FIELD OF THE INVENTION

This invention relates to a handheld appliance and in particular a hair care appliance such as a hairdryer.

BACKGROUND OF THE INVENTION

Generally, a motor and fan are provided which draw fluid into a body; the fluid may be heated prior to exiting the body. The motor is susceptible to damage from foreign objects such as dirt or hair so conventionally a filter is provided at the fluid inlet to the blower. The fan and heater require power in order to function and this is provided via internal wiring from either a mains power cable or batteries attached to the appliance.

Thermal protection is conventionally provided in the form of a thermal cut-out such as a bi-metallic strip or a thermal fuse. Thus, if the fluid flowing exceeds a pre-determined limit, the bi-metallic strip will break contact or the thermal fuse will melt, both causing a break in the electrical circuitry to the heater element.

SUMMARY OF THE INVENTION

According to a first aspect the invention provides a hairdryer comprising a heater, a fluid flow path and a thermal fuse wherein the fluid flow path extends from a fluid inlet to a fluid outlet, the heater extends within the fluid flow path from an upstream end of the heater to a downstream end of the heater and the thermal fuse extends across the downstream end of the heater.

Having the thermal fuse downstream of the heater means that the thermal fuse experiences the exit temperature of the heater which will be the hottest fluid so the reliability of the thermal cut-out is improved compared to other locations for the thermal fuse. For example if a hot spot is produced within the heater due to an accumulation of dirt and dust this would only trip the thermal fuse if the hot spot was located upstream of the thermal fuse thus, the entire heater is not monitored so there is a potential for the thermal fuse not to melt even if the pre-determined temperature is reached. This problem can be alleviated by having a lower pre-determined temperature but obviously there is then the risk of the cut-out being activated prematurely which is undesirable.

Preferably, the heater is generally cylindrical in shape and the thermal fuse extends at least partially radially across the downstream end of the heater.

It is preferred that the heater is annular in cross-section and the thermal fuse extends at least partially radially across the annular downstream end of the heater.

Preferably, the heater comprises an element, a scaffold around which the element is wound and an outer wall wherein the outer wall extends about the element and the scaffold. The element is preferably a wire which is folded into undulations to increase the surface area of the heater.

It is preferred that the thermal fuse is electrically connected to a circuit via a contact strip and the contact strip extends along the outer wall from an upstream end of the heater to the thermal fuse at the downstream end of the heater. The contact strip is a conducting element such as copper; it may be a wire but a strip is preferred as the aspect ratio is reduced so the strip sits against the outer wall of the heater.

Preferably, the contact strip extends along a radially outer surface of the outer wall of the heater.

It is preferred that the contact strip is folded over the downstream end of the outer wall.

Preferably, at a downstream end, the scaffold includes a recess for retaining the thermal fuse with respect to the heater.

It is preferred that a second thermal fuse is provided and the second thermal fuse is radially spaced from the thermal fuse and extends across the downstream end of the heater. Having a second fuse is advantageous as it means that more of the fluid flow path is being monitored for heat spikes.

Preferably, the second thermal fuse is electrically connected to the thermal fuse and the circuit. Ideally the second fuse mirrors the connections of the first fuse.

Also provided is a haircare appliance comprising a heater, a fluid flow path and a thermal fuse wherein the fluid flow path extends from a fluid inlet to a fluid outlet, the heater extends within the fluid flow path from an upstream end of the heater to a downstream end of the heater and the thermal fuse extends across the downstream end of the heater.

BRIEF DESCRIPTION OF THE DRAWINGS

The invention will now be described, by way of example only, with reference to the accompanying drawings, in which.

DETAILED DESCRIPTION OF THE INVENTION

Figure 1:
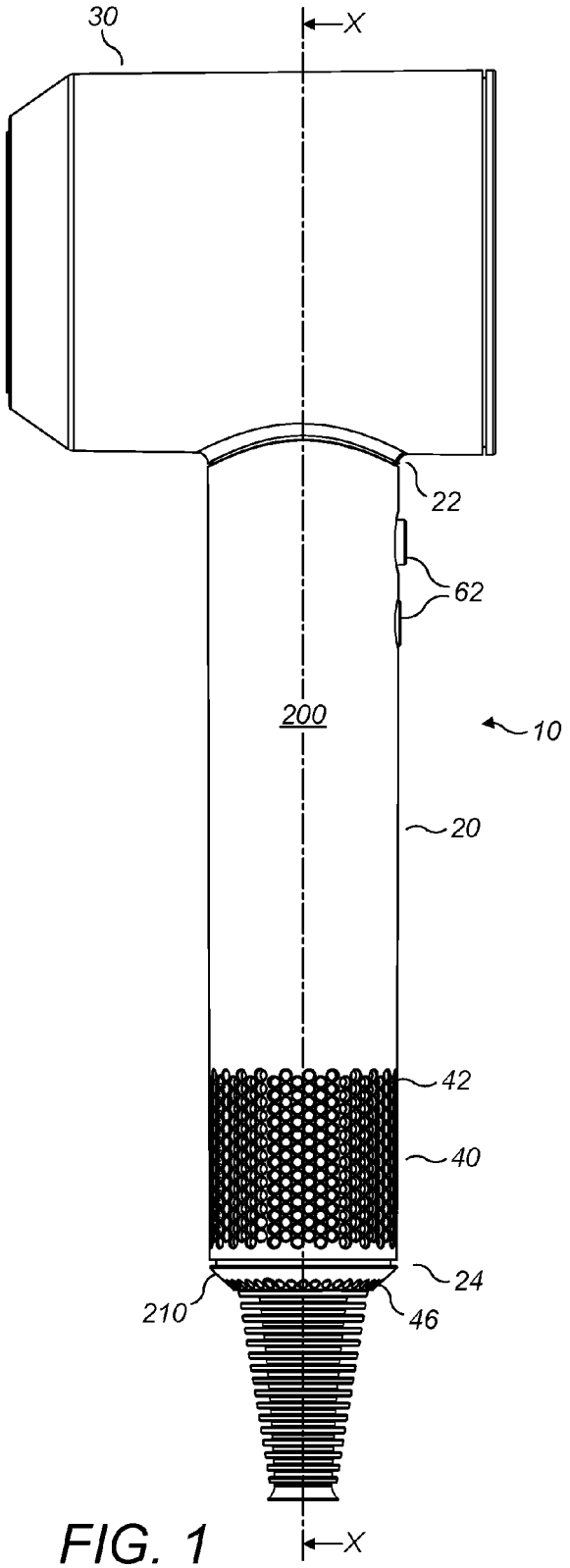
FIG. 1 shows a hairdryer in which a thermal fuse according to the invention may be used.
Figure 2:
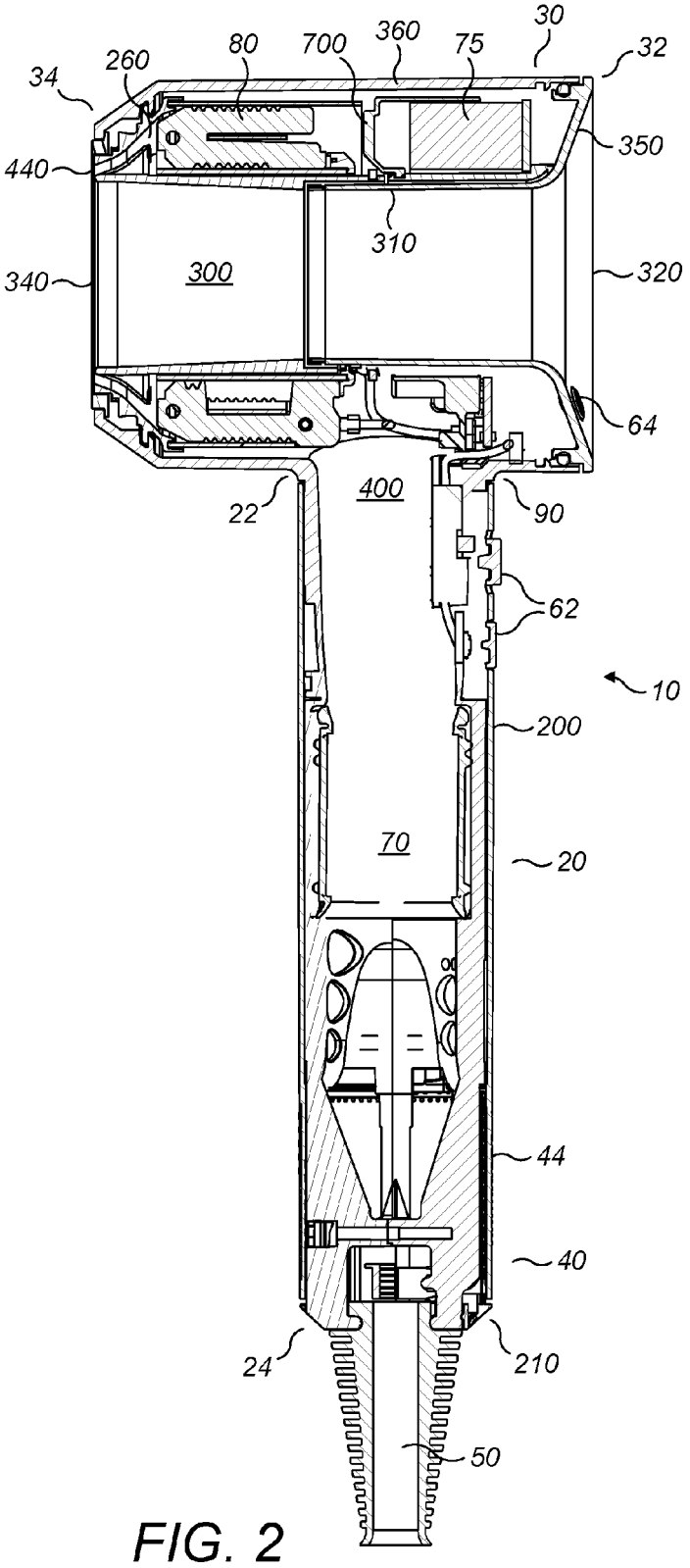
FIG. 2 shows a cross section through the hairdryer of FIG. 1.

FIGS. 1 and 2 show an example of hairdryer 10 with a handle 20 and a body 30 suitable for use with a thermistor according to the invention. The handle has a first end 22 which is connected to the body 30 and a second end 24 distal from the body 30 and which includes a primary fluid inlet 40. Power is supplied to the hairdryer 10 via a cable 50. At a distal end of the cable 50 from the hairdryer 10 a plug (not shown) is provided, the plug may provide electrical connection to mains power or to a battery pack for example.

The handle 20 has an outer wall 200 which extends from the body 30 towards a distal end 24 of the handle. At the distal end 24 of the handle an end wall 210 extends across the outer wall 200. The cable 50 enters the hairdryer through this end wall 210. The primary fluid inlet 40 in the handle 20 includes first apertures that extend around and along 42 the outer wall 200 of the handle in a series of rows and/or columns that extend from the distal end 24 of the handle 20 and second apertures that extend across 46 and through the end wall 210 of the handle 20. The first and second apertures form an initial filter for the primary fluid inlet and help to prevent hair and other foreign objects from entering. Ideally, a second finer filter 44 is provided. The cable 50 is located approximately in the middle of the end wall 210 so extends from the centre of the handle 20. The handle 20 has a longitudinal axis X-X along which the outer wall 200 extends from the body 30 towards the distal end 24.

Upstream of the primary fluid inlet 40, a fan unit 70 is provided. The fan unit 70 includes a fan and a motor. The fan unit 70 draws fluid through the primary fluid inlet 40 towards the body 30 through a primary fluid flow path 400 that extends from the primary fluid inlet 40 and into the body 30 where the handle 20 and the body 30 are joined 90. The body 30 has a first end 32 and a second end 34, the primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non-linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the inner duct 310 towards the primary fluid outlet 440 at the second end 34 of the body 30.

An inner wall 260 extends within the outer wall 360. The inner wall 260 at least partially defines the primary fluid outlet 440 and extends from the second end 34 of the body 30 between the inner duct 310 and the outer wall 360.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the inner duct 310 which is an inner wall of the body 30 and extends within and along the body. A fluid flow path 300 extends within the inner duct 310 from the fluid inlet 320 to the fluid outlet 340. At the first end 32 of the body 30, a side wall 350 extends between the outer wall 360 and the inner duct 310. This side wall 350 at least partially defines the fluid inlet 320. The primary fluid outlet 440 is annular and surrounds the fluid flow path.

A printed circuit board (PCB) 75 including the control electronics for the hairdryer is located in the body 30 near the side wall 350 and fluid inlet 320. The PCB 75 is ring shaped and extends round the inner duct 310 between the inner duct 310 and the outer wall 360. The PCB 75 is in fluid communication with the primary fluid flow path 400. The PCB 75 extends about the fluid flow path 300 and is isolated from the fluid flow path 300 by the inner duct 310.

The PCB 75 controls parameters such as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

Downstream of the PCB 75, is the heater 80 and a PCB baffle 700 is provided between the PCB 75 and the heater 80. The PCB baffle provides thermal protection for the PCB 75 when the heater 80 switched on amongst other things.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 2, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Figure 3:
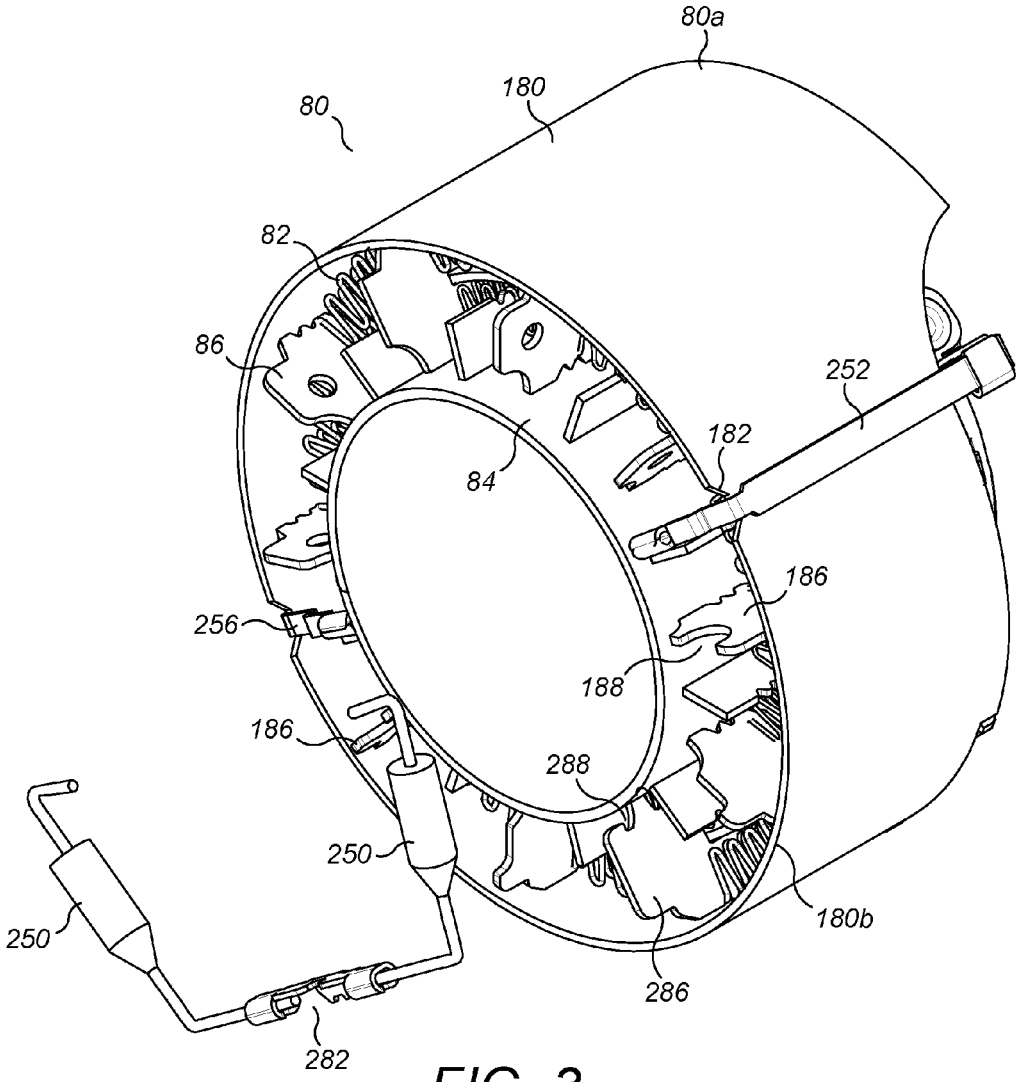
FIG. 3 shows an isometric view of a heater assembly.

FIG. 3 shows the heater 80 having a wall 180 which surrounds a heater element 82 and extends around the external periphery of the heater element 82 providing some thermal protection to the outer wall 360 of the body 30 of the hairdryer 10. The heater element 82 is a bent wire which is supported by a scaffold consisting of an inner tube 84 and a plurality of supporting struts 86 which extend radially between the inner tube 84 and the wall 180 and around which the heater element 82 is wound.

In the event of a blockage either to the fluid inlet 40 or the fluid outlet 440 of the hairdryer 10, the heater element 82 could overheat as fluid flow over the heater element 82 which acts to remove heat from the heater element 82 would be restricted. To prevent this, a number of safety features are provided.

Figure 4:
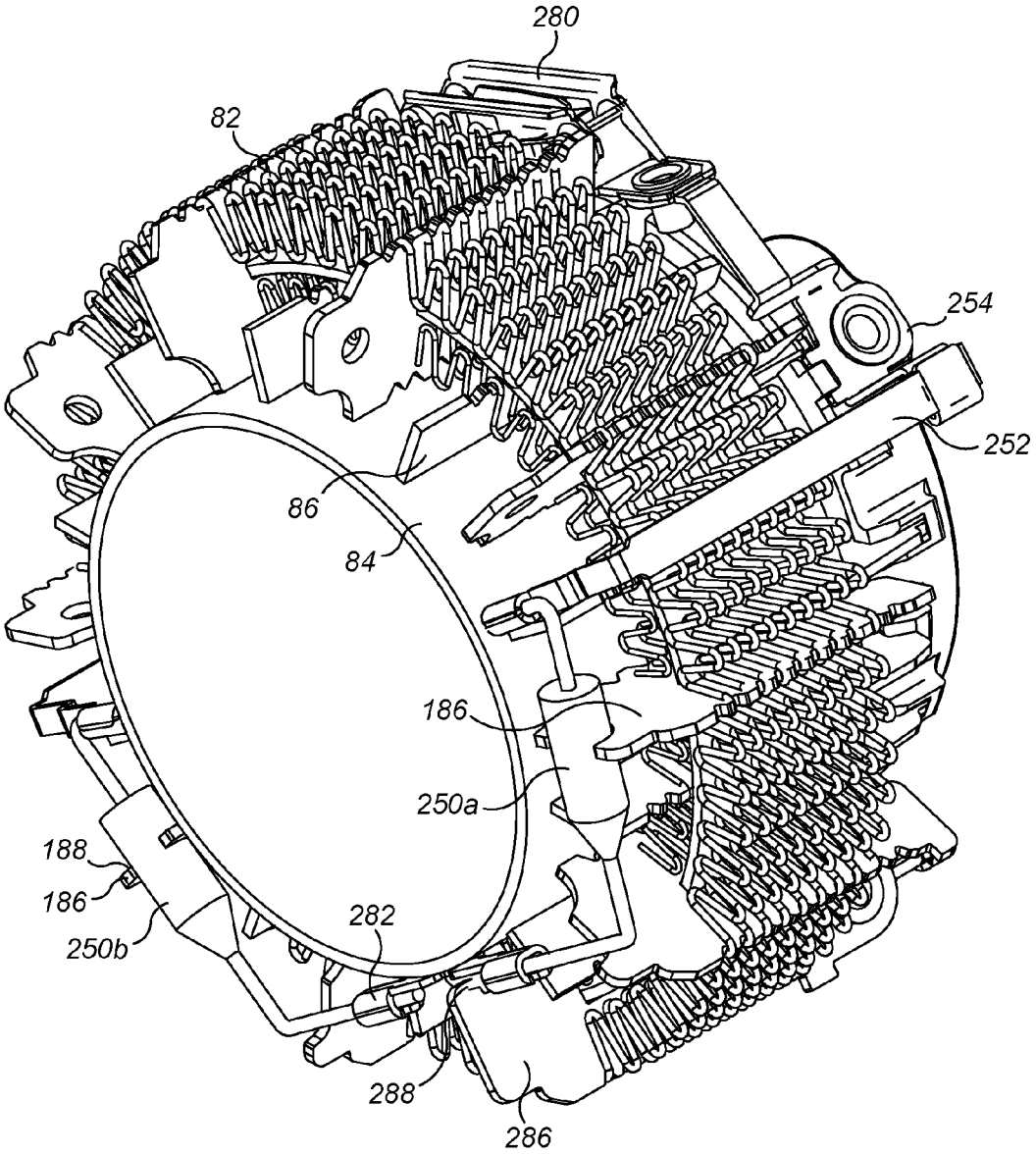
FIG. 4 shows an isometric view of the heater assembly of FIG. 3 without an outer wall.

Referring now to FIGS. 3 and 4 in particular, a first safety feature is in the form of a cut-out such as a bi-metallic strip 280 which is a resettable cut-out. Thus, following an increase in temperature which causes the bi-metallic strip 280 to break the circuit, the circuit is reset once the temperature decreases beyond the tripping temperature of the bi-metallic strip 280 and the circuit is completed once more.

A second safety feature is in the form of a pair of thermal fuses 250, this safety feature acts in the event that the bi-metallic strip 280 fails; the fuses cannot be reset. The pair of thermal fuses 250 are located within the fluid flow path 400 at the downstream end of the heater 80 thus the fuses are within the heated fluid flow. In normal use the pair of thermal fuses 250 are unaffected by the temperature of the fluid that flows past. However, in the event of a restriction or blockage, the temperature of the fluid around the pair of thermal fuses 250 increases. The pair of thermal fuses 250 each contain a fuse element which forms part of the electrical circuit to the heater and if the temperature of the fluid exceeds the melting temperature of a fuse element, it melts breaking the circuit and cutting power to the heater element 82.

In order to safely retain the pair of thermal fuses with respect to the heater 80, a pair of the supporting struts 186 of the heater 80 is provided with a notch or recess 188 which at least partially retains one of the pair of thermal fuses 250.

The pair of thermal fuses 250 are connected to the heater circuit via a conductive strip 252 made from copper, for example. The conductive strip 252 extends from a connecting rivet 254 located at the upstream end **80*a* of the heater 80 along an external periphery 180*a* of the outer wall 180 to a downstream end 80*b* of the heater 80. The conductive strip 252 is folded around the downstream end 180*b* of the outer wall 180. The first thermal fuse 250*a* is positioned within the recess or notch 188 and connected to the conductive strip 252**.

In this embodiment, the conductive strip 252 is folded round or crimped over one end of the thermal fuse 250, although alternative arrangements may be used. In addition, the conductive strip 252 need not extend along the whole length of the heater 80, this is convenient as connection points such as rivets are as positioned at an end of the heater where there is space to place them.

The outer wall 180 is provided with a notch 182 into which the connecting strip 252 is folded. This provides additional positional security for the first thermal fuse 250*a* and the connecting strip 252 with respect to the heater 80. In addition, by folding the connecting strip 252 into the notch 182 it provides structural reinforcement for the heater 80 particularly during assembly of the different elements of the hairdryer 10 within the body 30.

The outer wall 180 is made from a thermally insulating material such as mica. This thermally insulates the outer wall 360 of the body 30 and insulates the connecting strip 252 from the heater 80.

In this embodiment, the heater 80 is annular thus, the pair of thermal fuses 250 do not extend straight across the downstream end 80*b* of the heater 80, instead they are connected together in the form of a "U" so both extend across a portion of the heater element 82. The first 250*a* of the pair of thermal fuses 250 is crimped to a second 250*b* of the pair of thermal fuses 250*b* and a second connecting strip, which is preferably the mirror of the connecting strip 252 extends along the external periphery 180*a* of the outer wall 180 to a connecting rivet (not shown) located at the upstream end 80*a* of the heater 80 to complete that portion of the heater circuit.

In order to provide more stability for the part of the circuit that connects the thermal fuses to the rest of the heater circuit, another supporting strut 286 which lies centrally between the pair of supporting struts 188 is provided with a notch 288 into which the connecting crimp 282 is at least partially recessed when the pair of thermal fuses 250 are positioned correctly with respect to the heater.

The invention has been described in detail with respect to a hairdryer however, it is applicable to any appliance that draws in a fluid and directs the outflow of that fluid from the appliance.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art. In particular, the heater may be a conventional heater which is trapezoid in shape and wound around a frame formed into a cross shape.

The invention claimed is:

1. A hairdryer comprising a heater, a fluid flow path and a thermal fuse wherein the fluid flow path extends from a fluid inlet to a fluid outlet, the heater extends within the fluid flow path from an upstream end of the heater to a downstream end of the heater and the thermal fuse extends across the downstream end of the heater wherein the thermal fuse is electrically connected to a circuit via a contact strip and the contact strip extends along an outer external wall of the heater from an upstream end of the heater to the thermal fuse at the downstream end of the heater.

2. The hairdryer of claim 1, wherein the heater is generally cylindrical in shape and the thermal fuse extends at least partially radially across the downstream end of the heater.

3. The hairdryer of claim 2, wherein the heater is annular in cross-section and the thermal fuse extends at least partially radially across the annular downstream end of the heater.

4. The hairdryer of claim 1, wherein the heater comprises an element and a scaffold around which the element is wound, and wherein the outer wall extends about the element and the scaffold.

5. The hairdryer of claim 1, wherein the contact strip extends along a radially outer surface of the outer wall of the heater.

6. The hairdryer of claim 5, wherein the contact strip is folded over the downstream end of the outer wall.

7. The hairdryer of claim 4, wherein the scaffold includes a recess for retaining the thermal fuse with respect to the heater.

8. The hairdryer of claim 1, wherein a second thermal fuse is provided and the second thermal fuse is radially spaced from the thermal fuse and extends across the downstream end of the heater.

9. The hairdryer of claim 8, wherein the second thermal fuse is electrically connected to the thermal fuse and the circuit.

10. A haircare appliance comprising a heater, a fluid flow path and a thermal fuse wherein the fluid flow path extends from a fluid inlet to a fluid outlet, the heater extends within the fluid flow path from an upstream end of the heater to a downstream end of the heater and the thermal fuse extends across the downstream end of the heater, wherein the thermal fuse is electrically connected to a circuit via a contact strip and the contact strip extends along an outer external wall of the heater from an upstream end of the heater to the thermal fuse at the downstream end of the heater.

* * * * *